United States Patent [19]

Berger

[11] 4,270,663

[45] Jun. 2, 1981

[54] STOP FOR CRANE BOOM

[75] Inventor: Gerald P. Berger, Cedar Rapids, Iowa

[73] Assignee: FMC Corporation, San Jose, Calif.

[21] Appl. No.: 93,953

[22] Filed: Nov. 14, 1979

Related U.S. Application Data

[63] Continuation of Ser. No. 952,163, Oct. 17, 1978, abandoned, which is a continuation of Ser. No. 650,340, Jan. 19, 1976, abandoned.

[51] Int. Cl.[3] ..... B66C 23/06; B66C 13/48

[52] U.S. Cl. ..... 212/222; 212/153

[58] Field of Search ..... 212/222, 149, 153, 227, 212/231, 232, 255, 258, 265; 414/636, 673–674, 701, 719

[56] References Cited

U.S. PATENT DOCUMENTS

| | | | |
|---|---|---|---|
| 1,906,000 | 4/1933 | Finlay et al. | 414/719 |
| 2,440,199 | 4/1948 | Huston | 212/222 |
| 2,509,686 | 5/1950 | Huston | 212/222 |
| 2,708,039 | 5/1955 | Le Tourneau | 212/222 |
| 2,840,244 | 6/1958 | Thomas | 212/222 |
| 3,076,560 | 2/1963 | Bushorg et al. | 212/222 |
| 3,123,223 | 3/1964 | Markwardt et al. | 212/222 |
| 3,767,061 | 10/1973 | Tax et al. | 212/266 |
| 3,868,022 | 2/1975 | Greenlay et al. | 212/265 |
| 3,924,752 | 12/1975 | Hoofnagle | 212/153 |
| 4,005,780 | 1/1977 | Morrow, Sr. et al. | 212/222 |

FOREIGN PATENT DOCUMENTS

| | | | |
|---|---|---|---|
| 747054 | of 0000 | United Kingdom . | |
| 1116101 | 6/1968 | United Kingdom | 414/635 |
| 208225 | 10/1968 | U.S.S.R. | 212/153 |

*Primary Examiner*—Stephen G. Kunin
*Assistant Examiner*—R. B. Johnson
*Attorney, Agent, or Firm*—A. J. Moore; R. B. Megley

[57] ABSTRACT

A crane has a rotatable body with a vertically pivotal boom connected thereto. An energy absorbing stop unit is mounted in a fixed position on the body, and a guide sleeve is pivotally mounted on the body adjacent the stop unit. A stop rod is pivotally connected to the boom at a point between the ends of the boom for vertical swinging movement, and the rod is maintained in the guide sleeve in every position of the boom. The guide sleeve is pivoted by the stop rod into alignment with the stop unit at the extreme upper position of the boom, and, at that position of the boom, the stop rod extends through the guide sleeve into engagement with the stop unit.

5 Claims, 6 Drawing Figures

FIG_4
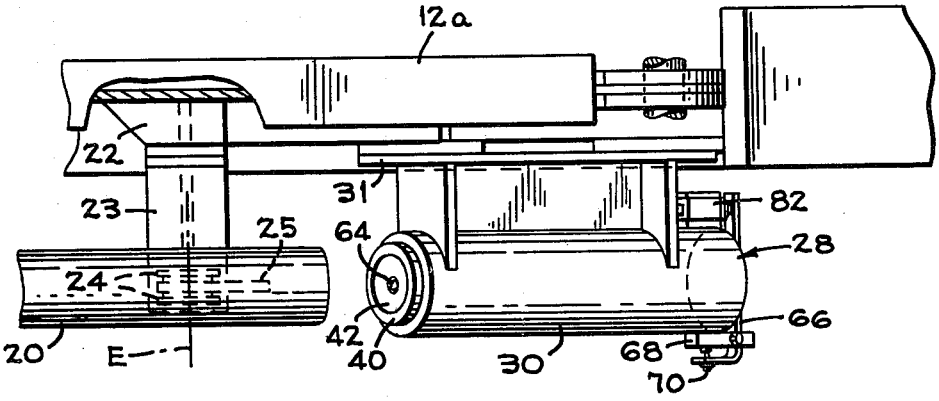
FIG_5
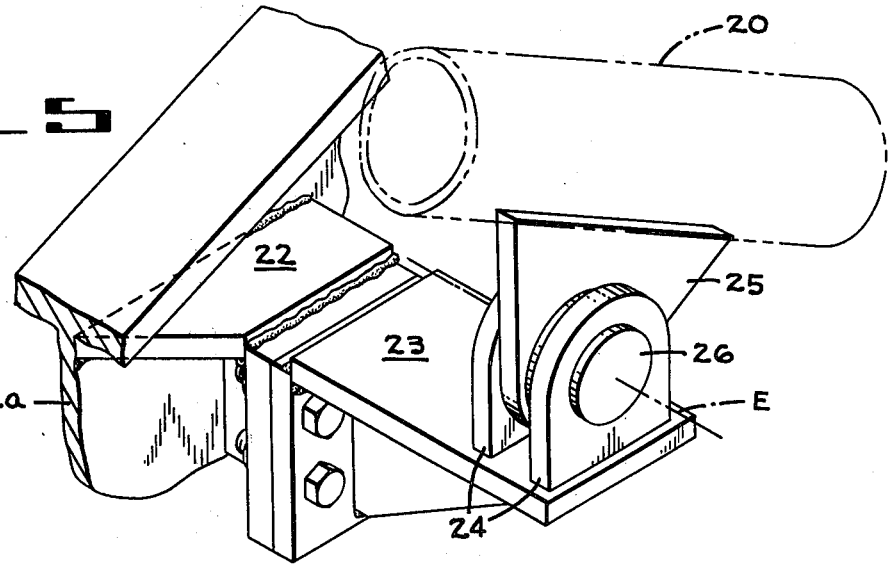
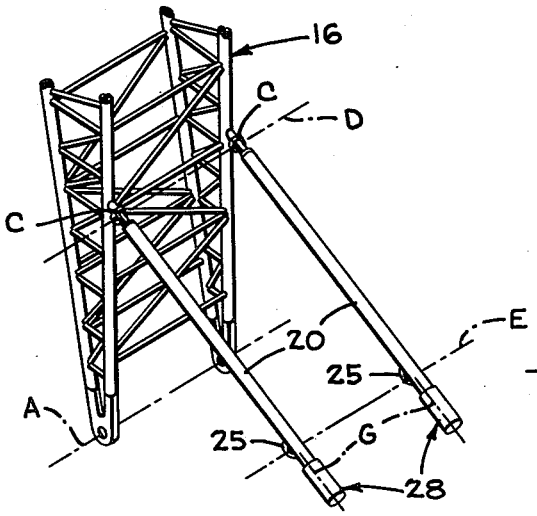
FIG_6

STOP FOR CRANE BOOM

CROSS-REFERENCE TO RELATED APPLICATION

This application is a continuation of Ser. No. 952,163 filed on Oct. 17, 1978, now abandoned, which in turn was a continuation of Ser. No. 650,340 filed Jan. 19, 1976 also abandoned.

BACKGROUND OF THE INVENTION

1. Field of the Invention

This invention relates to a boom crane and, more particularly, to a step for the boom of such a crane to prevent upward movement of the crane boom beyond a predetermined extreme upper position.

In boom cranes, the boom structure, which is usually pivotally mounted on the revolving superstructure of the machine for vertical swinging, is normally supported by wire ropes extending from a winch on the superstructure to the outer point of the boom, and the load is raised or lowered by a wire rope extending from a winch on the revolving superstructure over a sheave at the outer point of the boom. When such machines are in use, there is a danger that the boom will recoil, or swing upwardly past a vertical position and back over the frame, in the event the load is suddenly released, such as by the breaking of a wire rope.

Crane boom stops normally limit boom rotation by providing a physical connection between the revolving superstructure and the base section of the boom to limit the boom angle (angle between the horizontal and the boom centerline) to 90° or less.

2. Description of the Prior Art

Of the devices presently used to limit boom rotation beyond a predetermined extreme upper position, the most basic is the "fixed" or "rigid" type boom stop. This usually consists of some structure mounted rigidly to either the boom or the revolving superstructure. The structure is contacted by the member (boom or superstructure) at the desired maximum boom angle.

Another type of boom stop commonly used is one composed of two tubular struts, each pivotally connected to the superstructure. Two link-type members pivotally connect the boom lower section to the extending ends of the struts. These links, following the booms vertical rotation, guide the strut ends toward target pads on the boom. A similar operating boom stop device can be made by mounting the tubular struts to the boom and the guiding links to the revolving superstructure. (See U.S. Pat. Nos. 2,999,601; 3,123,223; and 3,647,087).

The "rail" type boom stop is another device sometimes used to limit boom elevation. Two tubular struts extend from the revolving superstructure toward the boom. These struts are not connected to the boom when the boom is at low angles. As the boom is raised to a working angle, rollers on the ends of the struts engage rails fastened to the boom. The rollers ride on the rails as the boom rises and guide the strut ends to targets on the boom when the boom attains a maximum angle. An example of the rail type stop for a boom is shown in U.S. Pat. No. 3,092,261.

Still another boom stop device utilizes wire rope to stop boom elevation. One or more wire ropes are attached to the revolving superstructure and pass under the boom hinge to attach to the under side of the boom.

As the boom reaches its highest angle, the wire ropes tighten and restrain the boom from further elevation.

Another type of boom stop consists of a pair of telescopic, strut-like members, which are pivotally connected to the revolving superstructure and the boom lower section. The strut-like members pivot vertically and telescope to allow the boom freedom to rotate in a vertical plane in the working range. The struts restrict the boom to some maximum angle by some means which stops the telescopic action at some preset maximum boom angle. The mechanism which incorporates the telescoping members has these advantages over the previously mentioned stop devices.

(1) With the telescopic device, the stopping force can be applied at a higher point on the boom than the other stop devices because of its telescopic ability to change length and follow boom elevation. The application of the stopping force at a higher point on the boom reduces stresses in the boom and stops when boom restraint is required.

(2) Telescopic devices do not have free ends which can oscillate while the machine is working because they are pivotally connected to both the revolving superstructure and the boom at all times.

(39 Telescopic devices utilize columnar members to carry the stopping force of the boom so that they may be sized to carry any load required. Wire ropes used in devices have a practical size limitation because they must be reasonably flexible.

Stop mechanism with telescopic members are shown in U.S. Pat. Nos. 2,479,838; 2,509,686; 2,627,985; 2,850,244; and 3,097,749.

Another boom stop device of interest is the one shown in U.S. Pat. No. 3,076,560. In this device two rods are pivotally connected to the boom. Each is received in a trunnion pivotally connected to the mast. A stop is fixed on the superstructure which is engaged by the rod when the boom reaches its extreme upper position.

Any or all of the previously mentioned stop devices may be equipped with some type of energy absorbing or energy dissipating mechanisms. The purpose of these mechanisms is to reduce the impact loadings encountered in stopping a recoiling boom. The energy absorbing devices commonly used include: spring, bumpers, and/or compressed air cushions.

SUMMARY OF THE INVENTION

In the present invention, a simple, effective stop mechanism is provided in which at least one stop rod is guided in a positive manner to a fixed stop unit when the boom approaches its extreme upper limit. In the preferred form of the invention, a pair of stop rods are pivotally connected to the boom (for vertical swinging movement), and a pair of stop units are fixed to the body, or superstructure, of the crane. An elongated sleeve is pivotally connected to the superstructure close to each fixed stop unit, and the stop rods are retained in the sleeves, in every position of the boom. As the boom reaches its extreme upper position, the stop rods extend through the sleeves and into engagement with the fixed stop units. Since the sleeves are pivotally mounted on a fixed axis to the same body on which the stop units are secured, and since the sleeves extend into close proximity to the stop units, the stop rods are positively guided, without risk of misalignment due to flexing of the crane members, into engagement with the stop units. The stop rods act as columns in compression when stopping the upward movement of the boom, and the sleeves prevent the columnar rods from buckling under the load imposed by the boom. At the same time, the device of the present invention incorporates all the advantages of conventional telescopic boom stop devices.

It is therefore one object of the present invention to provide a simple, effective boom stop for a crane.

It is another object of the invention to provide a boom stop wherein a member on the boom is guided in a positive manner into a stop unit on the superstructure.

It is still another object of the invention to provide a fixed stop unit for boom stopping engagement by a stop rod and to provide a guiding sleeve pivotally mounted on the same body member to which the fixed stop unit is secured.

It is yet another object of the invention to provide a boom stop where a stop rod acts as a column under compression and a sleeve prevents the column from buckling.

BRIEF DESCRIPTION OF THE DRAWINGS

FIG. 4 is a fragmentary plan view, taken on the line 4–4 of FIG. 2, of the stop mechanism.

FIG. 5 is a view in perspective of the guide sleeve mounting mechanism.

FIG. 6 is a schematic perspective view of the stop mechanism.

DESCRIPTION OF THE PREFERRED EMBODIMENT

Figure 1:
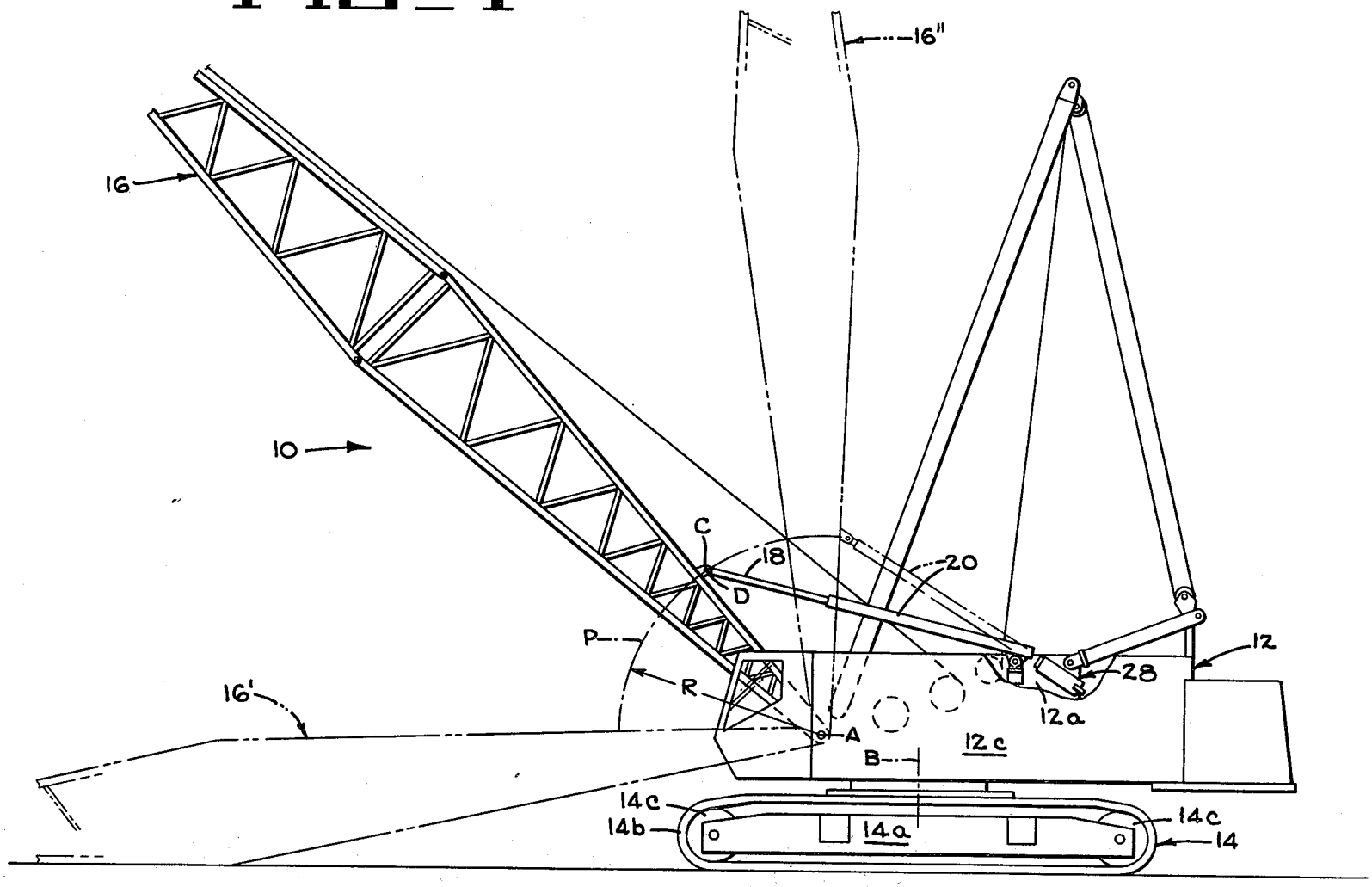
FIG. 1 is a side elevational view of a crane incorporating the boom stop of the present invention.

There is shown in FIG. 1 a crane 10 having a superstructure, or body, 12 and a carrier, or chassis, 14. The carrier 14 is shown with a frame 14*a* and an endless crawler track 14*b* mounted on sprockets 14*c* journaled in the frame, but it may, instead, comprise a frame with wheels. The body 12 has a frame 12*a* for mounting much of the crane machinery, a pedestal 12*b* on the frame for pivotally mounting a boom 16, and a housing 12*c* secured to and enclosing the frame. The boom 16 is pivotally connected to the pedestal 12*b* on axis A for vertical swinging movement, and body 12 is pivotally mounted on the chassis 14 for swinging movement about axis B.

An elongated stop rod 18 is connected at one end to each side of the boom 16 (at a point C) for pivotal movement with respect to the boom about a pivot pin in a pivotal mounting at horizontal axis D. It will be noted that each point C is spaced from the axis A about which the boom swings on the body a distance R. Thus, as the boom swings between a position on the ground (shown in dotted lines and indicated at 16′) and a desired extreme upper position (shown in dotted lines and indicated at 16″), the point C follows a circular path P about axis A. Consequently, the boom end of each stop rod 18 must move along the path P as the boom swings between the two extreme positions 16′ and 16″.

Figure 2:
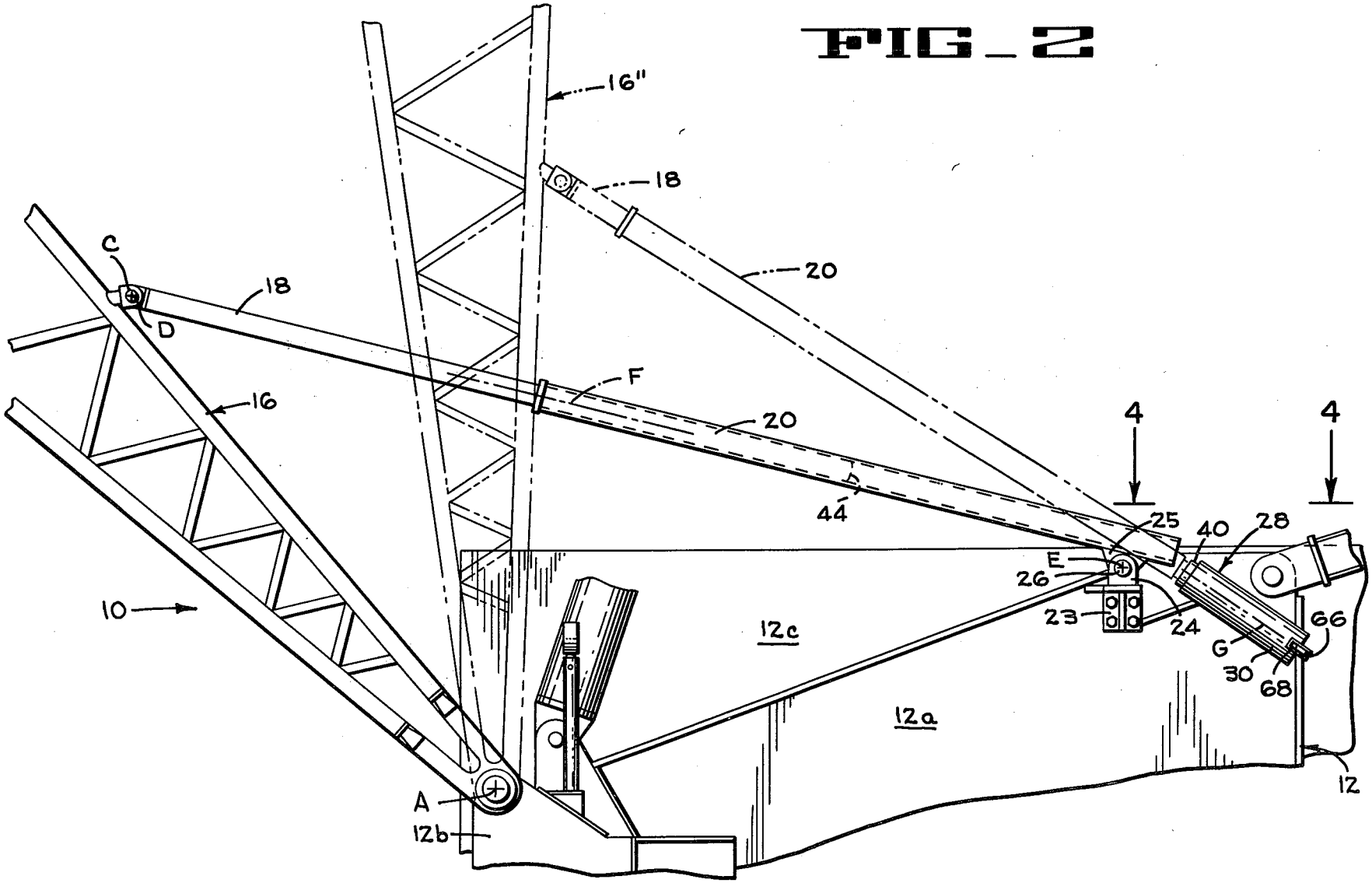
FIG. 2 is an enlarged view, taken as the view of FIG. 1, of the stop mechanism of the present invention.

As shown best in FIG. 2, an elongated guide sleeve 20 for each stop rod 18 is mounted to the body, or superstructure, 12 for pivotal movement about a pivot pin at horizontal axis E which is spaced from the sleeve and from the longitudinal axis F thereof. Each sleeve receives the stop rod 18 therein, and the sleeves are long enough to support the ends of the rods opposite the boom ends in any position of the boom between the two extreme positions 16′ and 16″. A bracket 22 is welded to the body frame 12*a* for each sleeve 20, and a support bracket 23 is secured to each bracket 22. Each support bracket has a pair of upstanding ears 24. An ear 25 secured to the end of the guide sleeve 20 remote from the boom, is received between the ears 24 and pivotally connected thereto by pin 26 which lies in the pivot axis E. Each stop rod 18 slides longitudinally in the sleeve 20 from an extended position in the sleeve when the boom is in the lower extreme position 16′, to a telescoped position in the sleeve when the boom is in the upper extreme position 16″. When the boom is in the latter position, each stop rod and sleeve will lie in an axis G, and the distal, or free, end of the stop rod will extend from the end of the sleeve (which is open at both ends) remote from the boom.

A stop unit 28 is secured to the body, or superstructure 12*a*, on each axis G for engagement by the distal, or free end of each stop rod 18 when the boom is in the desired upper extreme position 16″.

Figure 3:
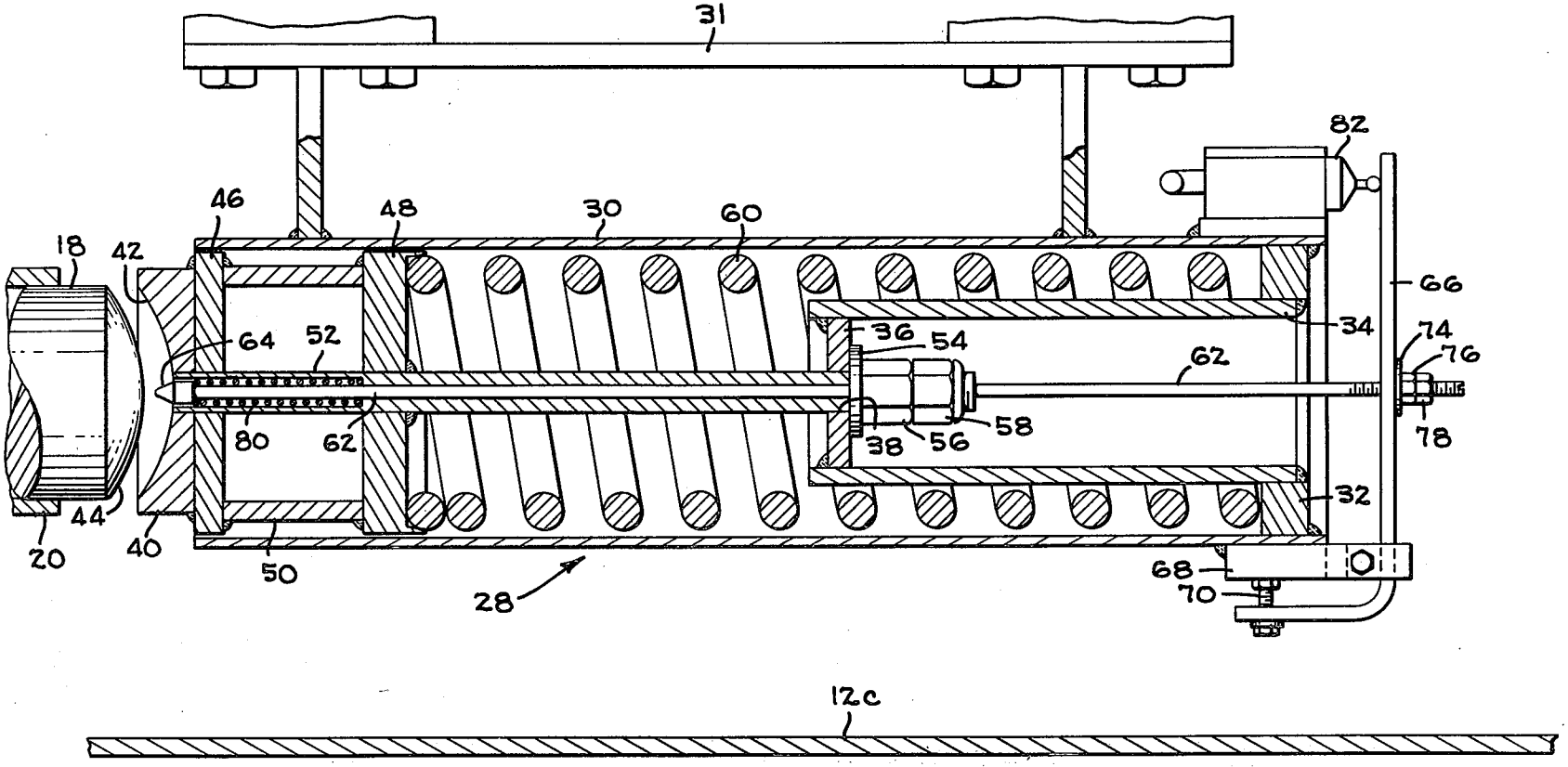
FIG. 3 is a central section of the energy absorbing device utilized in the stop mechanism, shown just before impact of the stop rod as the boom approaches its extreme upper position.

As shown best in FIG. 3, each stop unit has generally elongated outer casing 30 which is secured to the frame 12*a* of the body by a bracket 31. Each stop unit casing has a ring 32 secured in the lower, or remote, end thereof. A shorter, smaller inner tube 34 has its lower, or remote, end secured inside the ring. The upper end of tube 34 is closed by plate 36 which has a central opening 38 therein.

An abutment plate 40 forms part of a cushioned axial movement means and has a dished forward face 42 to receive the rounded free end 44 of stop rod 18, is mounted on a disc 46 which is received in the open front end of casing 30. A spring backing plate 48 is secured by spacer sleeve 50 to disc 46. A small tube 52 extends through backing plate 48, disc 46, and abutment plate 40 to terminate at its forward end in the center of the face 42. Tube 52, which is secured to plate 40, disc 46 and plate 48, extends rearwardly through the opening 38 in plate 36, but is not secured to the plate 36. A washer 54, nut 56 and lock nut 58 are received on the tube in sleeve 34, the washer in engagement with plate 36. The nuts, which are in threaded engagement with the tube, are drawn up against the washer to prevent forward movement of the tube 52 beyond the point where disc 46, which is secured to tube 52, is flush with the forward end of casing 30.

A suitable cushion means as a compression spring 60 is received in casing 30, over tube 34, and between rear ring 32 and spring backing plate 48. Thus, when the remote end 44 of stop rod 18 engages abutment plate 40 as the boom reaches its upper extreme position 16″, the assembly of plate 40, disc 46, spacer 50 and plate 48 is forced into the casing 30, compressing spring 60 to absorb the impact of the elevating boom. After the spring is compressed to stop the boom, the stored energy of the spring returns the head assembly (40, 46, 50 and 48) to the extended position with disc 46 flush with the end of casing 30.

An actuator rod 62, having a head 64, is received in tube 52 of one of the stop units. A lever 66 is held, by bracket 68 and bolt 70, over the remote end of casing 30 of that unit. Rod 62 extends through an opening in lever 66 and is prevented from forward movement with respect thereto by washer 74, nut 76 and lock nut 78. A spring 80, received in an enlarged bore portion of tube 52 and engaged with head 64 of rod 62, urges rod 62 forward with head 64 protruding from face 42 of abutment plate 40. When the head 64 is engaged by stop rod 18, the lever 66, which is biased away from casing 30, is released. As the lever 66 moves away from casing 30, the spring biased switch 82, mounted on casing 30, is released to cut the power to the boom elevating mechanism.

In operation of the stop mechanism of the present invention, it should be noted that the stop rods 18 are maintained within the sleeves 20 in every position of the boom 16. As the boom is raised, the boom end of each stop rod 18 moves in the circular arc P by virtue of its pivotal connection to the boom. The stop rods 18 thus swing the sleeves 20 toward the axis G as the boom approaches its extreme upper position 16''. As the distal end of the stop rods reach the abutment plates 40 of the stop units, the shock of the impact is absorbed by the spring 60. At the same time, the rod 62 is actuated to operate switch 82 and thereby shut off the boom elevating machinery.

Thus it will be seen that a simple, effective telescopic boom stop mechanism is provided in which stop rods act as column in compression as they transfer the impact of the elevating boom to shock absorbing stop units. The columns defined by the stop rods are guided into proper contact with the units by the sleeves by virtue of their offset pivot axis. At the same time, the guide sleeves, which themselves do not take any of the load of the elevating boom, confine the stop rods and prevent them from buckling.

Although the best mode contemplated for carrying out the present invention has been herein shown and described, it will be apparent that modification and variation may be made without departing from what is regarded to be the subject matter of the invention.

What is claimed is:

1. In a crane having a body and having a boom pivotally mounted to the body at a first location for swinging movement in a vertical plane, and further having boom stop mechanism connected between the body and boom to arrest further swinging movement of said boom when it reaches an upper extreme position, the improvement therein comprising:

a first rigid member defining an elongated sleeve open at both ends, said sleeve having a pivot connection fixed thereto adjacent one open end thereof and disposed in laterally spaced relation to said sleeve open end thereat whereby said open end is unobstructed by said pivot connection, a second rigid member defining an elongated rod slidably received in said sleeve and extending outwardly from the other open end of said sleeve to terminate in a pivot connection, said rod having a length greater than said sleeve so as to be enabled to slide therein to entend outwardly from said one sleeve end, a pivotal mounting on said body at a second location spaced from said first location and having a horizontal pivot axis fixed with respect to said body, a pivotal mounting on said boom having a horizontal pivot axis fixed with respect to said boom, a pivot pin interconnecting said body pivotal mounting and the pivot connection on one of said members for swinging movement of said member about said body fixed axis, a pivot pin interconnecting said boom pivotal mounting and the pivot connection on the other of said members for swinging movement of said member about said body fixed axis, said rigid members constituting the sole interconnection between said pivotal mounting, and, a stop unit rigidly affixed to said body in a predetermined position thereon, said stop unit having an elongated receiving means, abutment means disposed in said receiving means and mounted for axial movement therein, and cushion means interconnecting said receiving means and said abutment means, said stop means being mounted in spaced relation to said one end of said sleeve to permit said sleeve to pivot relative thereto as said boom swings, said abutment means being axially aligned with said sleeve when said boom reaches an upper extreme position thereby to receive said rod sliding outwardly from said one open sleeve end into abutting relation with said abutment means.

2. The boom mechanism of claim 1 wherein said abutment means has a dished end surface for engagement by said rod, said rod having a rounded end for complementary engagement with said dished suface.

3. The boom stop mechanism of claim 2 wherein said abutment means has further means at said end surface for signalling an alarm when engaged by said rod, and an alarm device connected thereto.

4. The boom stop mechanism of claims 1, 2, or 3 wherein said body pivotal mounting is connected to said first member and said boom pivotal mounting is connected to said second member.

5. The boom stop mechanism of claim 4 wherein said elongated sleeve member is of a length only slightly less than that of said rod member, whereby said sleeve member confines and guides linear portions of increasing length of said rod member in maintaining longitudinal alignment therebetween as said boom swings toward an upper position.

* * * * *